United States Patent [19]

Hawkins

[11] Patent Number: 4,658,469

[45] Date of Patent: Apr. 21, 1987

[54] SANITARY DOOR HANDLE HAVING A MATERIAL ADVANCING MECHANISM

[76] Inventor: Junior F. Hawkins, 3120 W. 16th, Wichita, Kans. 67203

[21] Appl. No.: 866,756

[22] Filed: May 27, 1986

[51] Int. Cl.[4] ..... B25G 1/00

[52] U.S. Cl. ..... 16/110 R; 16/124; 271/265

[58] Field of Search ..... 16/110 R, 124; 250/221; 271/265

[56] References Cited

U.S. PATENT DOCUMENTS

| | | | |
|---|---|---|---|
| 2,495,249 | 1/1950 | Gilbert | 250/221 X |
| 2,804,136 | 8/1957 | Ternes et al. | 16/124 X |
| 3,117,339 | 1/1964 | Vigna | 16/124 |
| 3,328,592 | 6/1967 | Shaw, II | 250/221 |

*Primary Examiner*—Fred Silverberg

[57] ABSTRACT

This invention provides a mechanism whereby a person may open a door without touching a surface which was previously touched by others opening the same door. Mechanism are provided for advancing material beneath a sturdy door handle in such a manner that when opening the door, a persons fingers will touch only the clean, advanced material and not the handle itself.

7 Claims, 5 Drawing Figures

SANITARY DOOR HANDLE HAVING A MATERIAL ADVANCING MECHANISM

BACKGROUND OF THE INVENTION

1. Field of the Invention

This invention relates to a sanitary means of opening a door.

2. Description of the Prior Art

Heretofore, except for electronically operated doors and gloves, there was no sanitary means available for opening a door. A door could not be opened without coming into contact with areas previously touched by others who had opened the same door.

SUMMARY OF THE INVENTION

Accordingly, several objects of my invention are . . . . This invention permits persons to enter or exit a room without touching a surface previously touched by others who had entered or exited the room.

Since the area touched in opening the door has not been touched by others, it eliminates the spread of germs and potential diseases which might otherwise occur through the physical contact with the door handle.

This would be especially important in restaurants, hospitals and related areas which by their very nature, must be especially clean and avoid the spread of disease of any kind as much as may be possible.

Another purpose of this invention is to eliminate the spread of disease and the need for gloves when opening certain cabinet doors and related enclosures as opposed to personnel door.

Further object of my invention will become apparent from consideration of the drawings and ensuing descriptions thereof.

DESCRIPTION OF THE PREFERRED EMBODIMENTS

Figure 1:
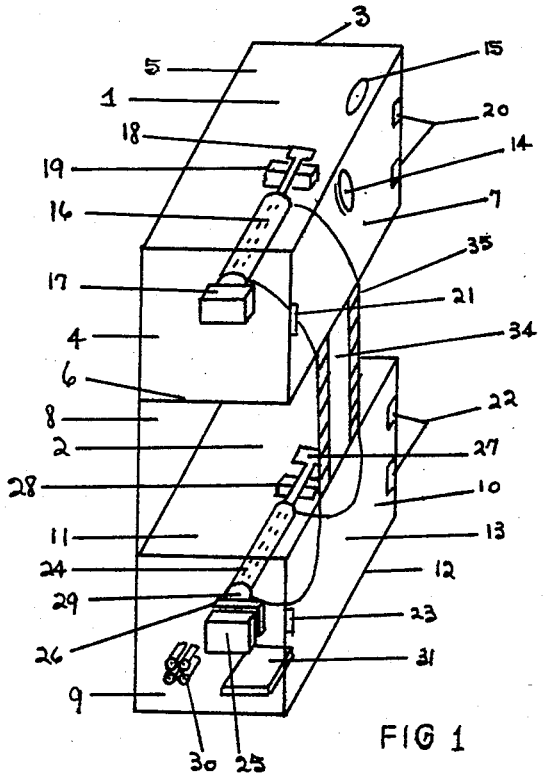
FIG. 1 is a general perspective view of my invention.

FIG. 1 is a view of the sanitary door handle showing a supply compartment 1 and an exposed material compartment 2.

The supply compartment 1 is formed by attaching the left end panel 4 and the right end panel 3 and the top panel 5 and the bottom panel 6 to the rear panel 8. In addition, the top panel 5 and the bottom panel 6 are attached to the left end panel 4 and the right end panel 3.

The front panel 7 is secured to the right end panel 3 or if desired to the left end panel 4 by the hinges 20 or or other suitable means which will permit the front panel 7 to be swung open or removed for removing empty or installing full supply spools 16 and to provide access to the interior of the supply spool compartment 1 when installing the unit to door. During normal operation the front panel 7 will remain closed and secured to the opposite end panel from the hinges 20 by a friction, magnetic or other suitable catch 21.

The exposed material compartment 2 comprises the rear panel 8 to which the left end panel 9 and the right end panel 10 and the top panel 11 and the bottom panel 12 are attached. In addition, the top panel 11 and the bottom panel 12 are attached to the left end panel 9 and the right end panel 10.

The exposed material compartment 2 front panel 13 is attached to the right end panel 10 or if desired to the left end panel 9 by the hinges 22 or other suitable means which will permit the front panel 13 to be opened or removed for removing take-up spools 24 filled with exposed material 35 from the supply spool 16 and for installing empty take-up spools 24 which will be used to wind future exposed material 35 from the supply spool 16 and to provide access to the interior of the cabinet for installing the unit securely to a door. During normal operation, the front panel 13 will remain closed and secured to the opposite end panel from the hinges 22 by a friction, magnetic or other suitable catch 23.

It should be noted that the cabinet may be constructed from plastic, metal, glass or other suitable material and may be formed to many configurations and sizes and shapes which will permit efficient operation of this device.

The door handle 34 protrudes from the supply compartment 1 through a recessed portion of the bottom panel 6 through an appropriate open space and then through a recessed portion of the top panel 11 and on into the exposed material compartment 2. The recessed portion of the bottom panel 6 and the top panel 11 permits the front panel 7 and the front panel 13 to close flush against other panels and also permits material 35 to be advanced from the supply compartment 1 into the exposed material compartment 2.

Material 35 from the supply spool 16 is advanced through the handle brackets 32 and handle bracket 33 which holds the material 35 immediately beneath the handle 34 in such a manner that when grasping the handle 34, your fingers and or hand will come into contact with the clean, untouched material 35 advanced from the supply spool 16 rather than handle 34. The handle 34 is used to provide the structural integrity required to open the door and may be constructed from steel, wood, plastic, glass, non-ferrous metal or similar material.

The material 35 advanced may be tape, cloth, paper, polyethylene, plastic or similar type of material which may be stored in the supply compartment 1 or is otherwise capable of being wound on the supply spool 16 and the take-up spool 24.

Figure 2:
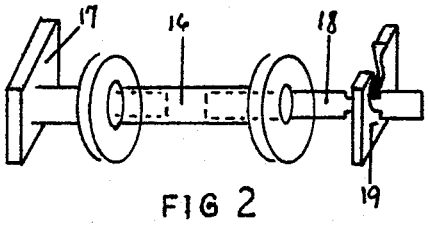
FIG. 2 is a detail view of the supply spool and its related components.

FIG. 2 is a detailed drawing of the supply spool 16 and its related components. The related components are the supply spool fixed bearing assembly 17 and the spool snap lock assembly 19 and the supply spool bearing assembly 18. The supply spool fixed bearing assembly 17 and the supply spool snap lock assembly 19 are attached to or otherwise made an integral part of the rear panel 8.

Initially, the supply spool 16 containing suitable material 35 is placed on one end of the supply spool fixed bearing assembly 17. The end of the supply spool fixed bearing assembly 17 which the supply spool 16 goes on is slightly smaller in diameter than the inside core diameter of the supply spool 16 which permits the supply spool 16 to turn on the supply spool fixed bearing assembly 17. The supply spool bearing assembly 18 is then placed in the opposite end of the supply spool 16 in a manner as shown in FIG. 2. The end of the supply spool bearing assembly 18 which is not inserted into the supply spool 16 is then pushed down into the supply spool snap lock assembly 19 and is subsequently locked into position.

Upward pressure will permit the supply spool bearing assembly 18 to be "Unlocked" from the supply spool snap lock assembly 19 when it is necessary to remove an empty supply spool 16.

The two different diameters of the supply spool bearing assembly 18 permits the supply spool 16 to be installed in only one correct position. The end of the supply spool bearing assembly 18 inserted into the supply spool 16 is slightly smaller in diameter than the inside core diameter of the supply spool 16 which permits the supply spool 16 to turn which permits the material 35 wound on the supply spool 16 to be placed immediately beneath the handle 34 and eventually wound onto the take-up spool 24.

Figure 3:
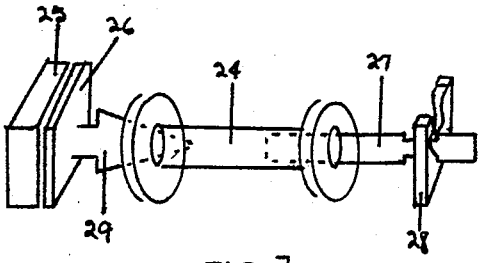
FIG. 3 is a detail view of the take-up spool and its related components.

FIG. 3 shows the take-up spool 24 and its related components. These related components are the motor 25; the motor mounting bracket 26; the friction spindle assembly 29; the take-up spool bearing assembly 27 and the take-up spool snap lock assembly 28.

The motor mounting bracket 26 and the take-up spool snap lock assembly 28 are constructed of plastic, metal or similar material and are attached to or otherwise made an integral part of the rear panel 8.

The motor 25 is attached to the motor mounting bracket 26 with scews or by other suitable means which will assure that the motor 25 is firmly secured in its proper location.

The friction spindle assembly 29 is attached to the motor 25 or otherwise made a part of the motor 25 in such a manner that when the motor 25 is energized, the friction spindle assembly 29 will turn and when inserted into the take-up spool 24, it will cause the take-up spool 24 to turn and wind up material 35 which was previously placed on the supply spool 16.

The friction spindle assembly 29 is cone shaped and covered in a sandpaper type of material or constructed of perforated metal; perforated plastic or similar type of material which when inserted into the inside core of the take-up spool 24, sufficient friction and pressure will exist to turn the take-up spool 24 whenever the motor 25 is energized.

One end of the take-up spool bearing assembly 27 is inserted into the opposite end of the take-up spool 24. The opposite end of the take-up bearing assembly 27 is then pushed downward into the take-up spool snap lock assembly 28 and is subsequently locked into its proper position. The take-up bearing assembly 27 may be removed by reversing the above procedure and placing upward pressure on the take-up spool bearing assembly 27. Once the take-up bearing assembly 27 has been removed from the take-up spool 24, the take-up spool 24 may be pulled from the friction spindle assembly 29 so a new empty spool may be installed.

The end of the take-up bearing assembly 27 inserted into the take-up spool 24 has a diameter which is slightly smaller in diameter than the inside core diameter of the take-up spool 24 thereby permitting this end to turn freely whenever the motor 25 is energized.

The two different diameters of the take-up spool bearing assembly 27 assure that the take-up spool 24 is secured into its proper position which insures that there is sufficient pressure on the friction spindle assembly 29 to make the take-up spool 24 turn whenever the motor 25 is energized.

When your hand or other object is placed in front of the front panel sensor 14, the motor 25 will be energized by the electric control circuit 31 and battery supply 30 and the material 35 wound on the supply spool 16 will be advanced beneath the handle 34 and exposed material 35 will be placed on the take-up spool 24. Removing your hand or other object from in front of the front panel sensor 14 will result in the motor 25 being de-energized by the electric control circuit 31 and battery power supply 30 and the advancement of material 35 stopped. The top panel sensor 15, shown on the top of the cabinet but may be placed elsewhere, is a control sensor which senses when the overhead or normal room lighting has been removed and in-activates the front panel sensor 14 in such a manner that the material 35 cannot be advanced when the normal room lighting is not striking this top panel sensor 15. Without this top panel sensor 15, the material 35 would advance each time the normal room lighting was extinquished.

The front panel sensor 14 and the top panel sensor 15 are commonly called photo-cells or light sensitive resistors. Other type of switches including proximity switches could also be used in these areas.

A battery power supply 30 is indicated but other types of power may be used including A.C. and A.C. to D.C. converters which are commercially available.

Figure 4:
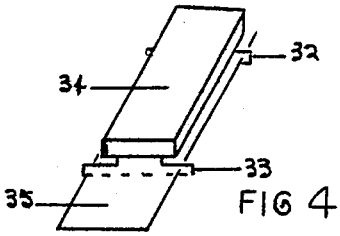
FIG. 4 is a detail view showing the handle and the handle brackets.

FIG. 4 is a detailed view of the door handle 34 and the handle bracket 32 and handle bracket 33. The handle brackets 32 and 33 are constructed from plastic, wire, metal or other suitable material which is attached to or otherwise made an integral part of the handle 34 in a manner suitable for holding the material 35 from the supply spool 16 near the bottom of the handle 34 in such a manner that when grasping the handle 34, the fingers or hand will come into contact with the material 35 instead of the handle 34.

Figure 5:
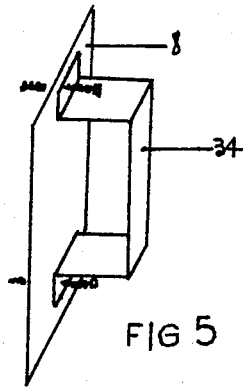
FIG. 5 is a detail view of the handle and rear panel.

FIG. 5 is a detailed view showing how the handle 34 is secured to the rear panel 8. The door handle 34 is attached to the rear panel 8 by screws, glue, brackets or other suitable means or otherwise made an integral part of the rear panel 8 and then this entire assembly is secured to the door by screws which protrude through both the handle 34 and the rear panel 8 and on into the door.

Since many other modifications and purposes of this invention will become apparent to those skilled in the art upon perusal of the foregoing descriptions, it is understood that certain changes in style, size and location of components may be made without a departure from the spirit of the invention and still remain within the scope of the following claims.

What I claim is:

1. A sanitary door handle device which permits a door to be opened without touching an area which was previously touched by others who had opened the same door comprising:

a cabinet comprising a supply compartment and an exposed material compartment;

a handle which extends between said compartments with means for advancing clean material immediately beneath said handle in such a manner that when grasping said Handle to open the door, the fingers will touch only said clean material and not said handle;

a rotatable supply spool for clean material and means for securing said supply spool inside said supply spool compartment;

a rotatable take-up spool for exposed material and means for securing said take-up spool inside said exposed material compartment;

an electric motor and driving arrangement which will turn said take-up spool and wind said exposed material on said take-up spool and simultaneously advance clean material from said supply spool to said take-up spool, which is located immediately beneath said handle, when said motor is energized;

an electric control circuit comprising means for energizing said motor when your hand is placed in front of the front panel light sensitive sensor and de-energizing said motor when said hand is removed from in front of said front panel light sensitive sensor;

a control top panel light sensitive sensor secured in such a manner that said electric control circuit will de-energize said motor when normal room lighting is absent.

2. The sanitary door handle device as defined in claim 1 wherein said supply compartment and said exposed material compartment has a recessed area which permits clean material to be advanced from said supply spool onto said take-up spool.

3. The sanitary door handle device as defined in claim 1 wherein said cabinet comprises means for accessing the interior of said cabinet for securing said cabinet to a door and for installing new material and removing exposed material.

4. The sanitary door handle device as defined in claim 1 wherein said clean material is held near the underside of said handle by handle brackets.

5. The sanitary door handle device as defined in claim 1 wherein a supply spool fixed bearing assembly and a supply spool removable bearing assembly and a supply spool snap lock assembly secures said supply spool into a position which permits proper operation of said device.

6. The sanitary door handle device as defined in claim 1 wherein a take-up spool bearing assembly; a take-up spool snap lock assembly and said driving arrangement secures said take-up spool into a position which permits proper operation of the device.

7. The sanitary door handle device as defined in claim 1 wherein said driving arrangement comprises a cone shaped, friction drive means.

* * * * *